United States Patent [19]

Kawamoto et al.

[11] Patent Number: 5,059,482

[45] Date of Patent: Oct. 22, 1991

[54] COMPOSITE FIBER AND PROCESS FOR PRODUCING THE SAME

[75] Inventors: Masao Kawamoto; Kazuhiko Tanaka; Kiyoshi Hirakawa; Shinji Yamaguchi; Tomoyasu Takegami, all of Kurashiki, Japan

[73] Assignee: Kuraray Company, Ltd., Kurashiki, Japan

[21] Appl. No.: 404,208

[22] Filed: Sep. 7, 1989

[30] Foreign Application Priority Data

Sep. 13, 1988 [JP] Japan ..... 63-230296

[51] Int. Cl.[5] ..... D02G 3/00

[52] U.S. Cl. ..... 428/373; 428/364; 428/369; 428/370; 428/374; 428/397

[58] Field of Search ..... 428/364, 373, 369, 397, 428/370, 374; 525/56, 58

[56] References Cited

U.S. PATENT DOCUMENTS

| | | | |
|---|---|---|---|
| 3,892,583 | 7/1975 | Winter et al. | 501/92 |
| 4,222,926 | 9/1980 | Mizuno et al. | 525/58 X |
| 4,284,671 | 8/1981 | Cancio et al. | 525/56 X |
| 4,315,968 | 2/1982 | Suplinskas et al. | 428/367 |
| 4,340,636 | 7/1982 | DeBolt et al. | 428/215 |
| 4,628,002 | 12/1986 | Suplinskas et al. | 428/367 |
| 4,657,991 | 4/1987 | Takamizawa et al. | 525/477 |
| 4,786,685 | 11/1988 | Takida et al. | 525/56 X |
| 4,883,699 | 11/1989 | Aniuk | 525/58 X |
| 4,898,778 | 2/1990 | Loszewski | 428/367 X |

FOREIGN PATENT DOCUMENTS

| | | |
|---|---|---|
| 0064568 | 11/1982 | European Pat. Off. . |
| 0104081 | 3/1984 | European Pat. Off. . |
| 0239301 | 9/1987 | European Pat. Off. . |

OTHER PUBLICATIONS

WPI, File Supplier, Derwent Publications Ltd., London, GB; AN-78-71369A & JP-A-53 098 420 (Toray Inds Incl) 28-08-1978.

*Primary Examiner*—Lorraine T. Kendell

*Attorney, Agent, or Firm*—Oblon, Spivak, McClelland, Maier & Neustadt

[57] ABSTRACT

Provided is a composite fiber comprising an ethylenevinyl alcohol copolymer (component A) and a polyester (component B) heterogeneously blended with each other. In the cross section of the fiber, component A is distributed in islands form locally, and the region of component B where component A is not present containing a component B zone containing a circular area having a diameter at least 1/20 that of the fiber. By assuming the above structure, the fiber has good bulk, touch and silhouette, and a feeling similar to that of natural fibers, having solved the problems inherent to polyester fibers, such as oil soiling, soil redeposition by washing and soiling by sublimation and migration of disperse dye, while making use of superior features of polyester fiber, such as high strength, modulus, abrasion resistance, chemical resistance, weather resistance and dimensional stability.

2 Claims, 3 Drawing Sheets

COMPOSITE FIBER AND PROCESS FOR PRODUCING THE SAME

BACKGROUND OF THE INVENTION

1. Field of the Invention

This invention relates to composite fibers comprising heterogeneous composition of an ethylene-vinyl alcohol and a polyester, having high functionalities and aesthetic feeling, and also to the process for producing them.

2. Description of the Prior Art

Polyester fibers are being produced and consumed on a very big scale, thanks to their general-purpose characteristics such as excellent strength and modulus, abrasion resistance, chemical resistance, weather resistance and dimensional stability, which are far superior to those of natural fibers. However, on the other hand, the polyester fibers are, in the field of end-uses of fabrics and clothing which should have high-grade feeling, still inferior to natural fibers in aesthetic feeling and/or high-grade feeling in spite of many efforts made so far to improve the shape of the filament, the structure of the yarn and the like. Furthermore, the polyester fibers still have the following soiling or dirting problems: they are inferior to cotton in the darkening of white cloth, which is a problem of soil redeposition; they are liable to be oil-soiled; their coated products such as polyurethane-coated fabric suffer a problem of color transfer due to migration of disperse dye; and the like. Although the above-mentioned problems of polyester fibers had long been intensively studied, it has been found that such polyester fibers have no or, if any, very small amount of hydrophilic groups, or are modified by copolymerization to only a very small extent or only at the ends of molecules thereof cannot fully solve the above problems. It has also been found that introduction of too large an amount of hydrophilic groups would impair inherent properties of the fiber substrate to make the fiber unusable for the practical purpose and that modification of polymer simply by copolymerization or the like has only limited effect.

Study on why natural fibers such as cotton, silk and wool have excellent hand and aesthetic appearance, or high resistance to soiling has clarified that the natural fibers all have hydrophilic groups to thereby exhibit superior features in the following way when they are processed by using water.

All the natural fibers swell upon absorption of water. Then, the single filaments swell to thicken by about 30 percent in apparent sizes and, also, yarns comprising the filaments will become still thicker due to minute deformation of filaments upon swelling, e.g. crimping of wool by bilateral structure, distortion of cotton by convolution, nonuniform waving of silk, etc., thereby bending and fixing the texture or stitch. If, a fabric comprising such yarn is then dried, the apparent thickness attained upon the swelling now decreases to assure clearances between the filaments, while the texture or stitch is still fixed. Consequently, the contact pressure between the filaments and between the crossing yarns is decreased, and any restricting force therefore will not work when the fabric is deformed by bending, shear, elongation or recovery therefrom to thereby decrease hysteresis loss. This fact gives the fabric larger resilience and liveliness.

It has also been found that the problem of darkening by soil redeposition at washing or soiling by sublimation and migration of disperse dye can markedly be improved by coating the surface of polyester filaments with a hydrophilic polymer.

The present inventors have, taking the above points into consideration, aimed at application of ethylene-vinyl alcohol copolymer to polyester fibers. The ethylene-vinyl alcohol copolymer can, since it swells by absorption of water and has hydrophilic groups, solve the above-described problem of oil dirting or darkening by soil redeposition at washing, and be free from the problem of soiling by sublimation and migration of disperse dye, which problems are inherent to polyester fibers. The present invention is achieved by pursuing and clarifying how to make up ethylene-vinyl alcohol copolymer and polyester into a fiber which can make use of the features of the two.

Japanese Patent Publication No. 5223/1971 discloses a shaped article of polyester comprising ethylene-vinyl alcohol copolymer, which is a hydroscopic polymer, homogeneously mixed therewith to improve the static property of polyester.

However, fibers having a homogeneous blend structure of polyester component and ethylene-vinyl alcohol copolymer component give woven fabrics or knitted fabric being short of bulk and having poor hand, as compared to fibers of heterogeneous blend structure. In the course of study to pursue the reason of this, it was found that the fiber having a homogeneous blend structure shrinks uniformly and deforms only little when immersed in high-temperature hot water.

On the other hand, it was found that in the case of a fiber of heterogeneous blend structure minute deformations generate at various parts, some part bending and some part distorting, when such fiber is immersed in high-temperature hot water. The reason is considered to be that since ethylene-vinyl alcohol copolymer, which swells by absorption of water, is present at localized parts in the cross section of a fiber, strain by swelling will give minute deformations at localized parts in the fiber, which fact then leads to improvement in the bulk and "taste" of an aggregate of the fibers. This is quite similar to the behavior of natural fibers in which minute deformations generate upon swelling.

SUMMARY OF THE INVENTION

Accordingly, the first invention of the present invention provides a composite fiber of ethylene-vinyl alcohol copolymer and polyester heterogeneously blended with each other, comprising a saponified product of an ethylene-vinyl acetate copolymer (A) having an ethylene content of 30 to 70 mol % and a saponification degree of at least 95% and a thermoplastic polyester (B) containing polyethylene terephthalate and/or polybutylene terephthalate as a principal component(s) in a blending ratio by weight of A:B=5:95 to 40:60, said component A being distributed in islands form in the cross section of the fiber, the region of said component B where component A is not present in the cross section of the fiber containing a component B zone containing a circular area having a diameter at least 1/20 that of the fiber.

The composite fiber according to the above first invention has, basically, the following feeling and functionalities:

i) gives fabrics having high bulk and good touch as well as high drapability and silhouette; and ii) suffers no soil redeposition by washing and no sublimation and migration of disperse dye.

The second invention of the present invention provides an aggregate of composite fibers comprising ethylene-vinyl alcohol and polyester heterogeneously blended with each other, said fibers each originating from the composite fiber of heterogeneous blend of the first invention, said component B in the surface layer having been eroded by alkali treatment to allow only said component A to remain in the surface layer to thereby form a irregularly roughened surface, and any one of said fibers in the aggregate having a cross sectional shape different from those of others.

The fiber aggregate of the second invention is obtained by alkali, treatment of an aggregate of the composite fiber of the first invention. The fiber has, basically, the feeling and functionalities possessed by the fiber of the first invention, and also has, thanks to its unique cross-sectional shape, a feeling quite similar to that of natural fibers and far apart from those of conventional synthetic fibers.

The third and fourth inventions of the present invention provide a process for producing the composite fiber of the first invention and that for producing the fiber aggregate of the second invention respectively.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

In all these FIGURES, the diameter, D, of a circumscribed circle of the fiber cross section and the diameter, L, of an apparent circle having the same area as that of a space occupied locally by component B are shown.

Figure 5:
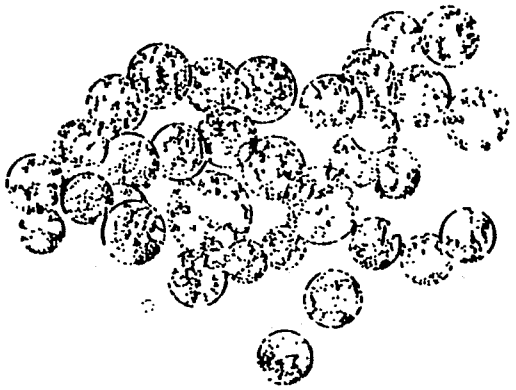

FIG. 5 is a photograph to show the shapes of the fibers having been subjected to alkali etching treatment, whereby component B has been eroded by alkali solution to give roughened surfaces.

Figure 6:
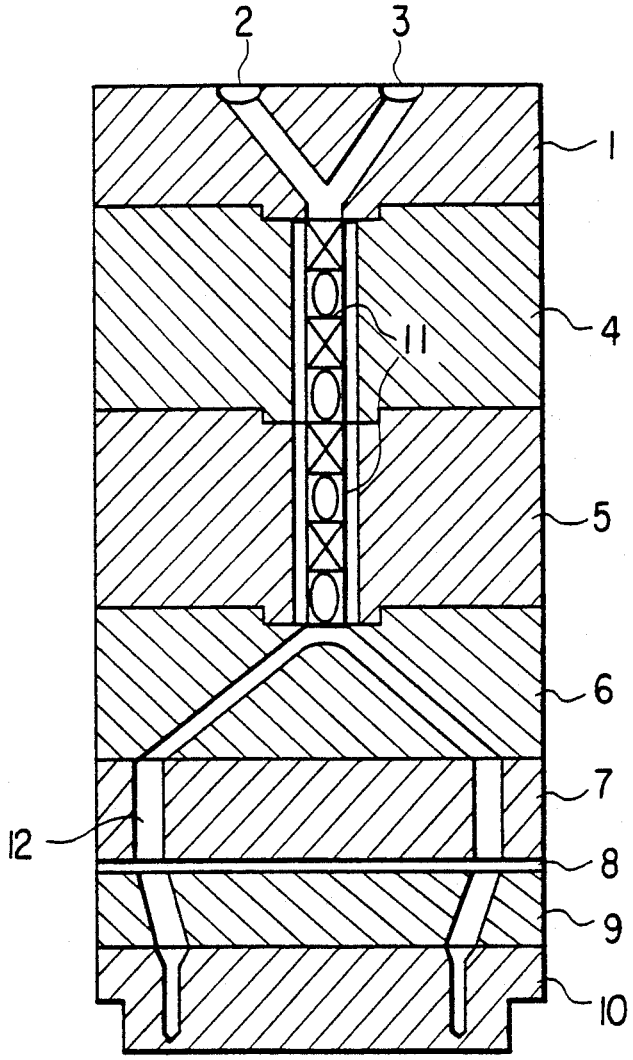

FIG. 6 is a cross-sectional view showing an example of the spinning apparatus for producing the composite fiber of the present invention, wherein 1 is inlet plate for polymer melts having holes, 2 and 3 for introducing the melts, 4 and 5 are mixing plates, 6 is an intermediate plate, 7 is a sand box, 8 is a filter, 9 is a flow straightening plate, 10 is a spinneret, 11 is a static mixer and 12 is a filtration zone.

DETAILED DESCRIPTION OF THE PREFERRED EMBODIMENTS

The distribution in the fiber cross section of components A and B is known by transmission-type optical microscopy. FIGS. 1 through 4 are sketches copying the photographs, wherein black spots represent ethylene-vinyl alcohol copolymer component (A) while the vacant areas other than the black spots represent polyester component (B).

In the composite fiber of the present invention, component A is distributed in the form of fine islands, the distribution being irregular to localize the sea region corresponding to the island region, i.e. component B, in the cross section of the fiber. The effectiveness of degree of the irregular distribution of component A or localization of component B is judged in the present invention by whether in the region of component B containing no component A there be present a space which can contain a circular area having a diameter, L, at least 1/20 that of the fiber diameter. The fiber diameter, D, herein means: when the fiber has a circular cross section, the diameter of the cross section; and when the fiber has a irregularly-shaped cross section, the diameter of its circumscribed circle.

In the composite fiber of the present invention, the diameter, L, of a circular area in the component B zone containing no component A is at least D/20, and preferably D/10 to D/2. If L is less than D/20, the fiber will be not much different from fibers of homogeneously blend and the effect will be minimized, though this does not hold true always depending on the blending ratio of component A and component B. The number of the zones of component B containing the circular area having a diameter at least D/20 is not restricted to 1 but several numbers of such zones may be present locally or maldistributedly. An L of between D/10 to D/5 gives fabrics having still preferred feeling and touch. Another feature of the composite fiber of heterogeneous blend of the present invention lies in the irregular distribution of the heterogeneity of the fiber cross section among individual fibers as well as along fiber length.

The above composite fiber of heterogeneous blend changes, when treated by alkali etching which will erode the polyester component in the surface layer, to a fiber having a roughened surface with streaky projections and concaves very randomly distributed thereon. Then, such fiber will have a streakily roughened surface similar to or even of higher degree than that of fibers obtained by wet spinning process, thereby improving the touch without any waxy feeling of the fabric comprising them. Besides, the ethylene-vinyl alcohol copolymer that alkali could not erode remains deposited on the surface layer to make the fiber structure as if the fiber surface were coated with thin film of ethylene-vinyl alcohol copolymer. Then, the deposited component A coating the fiber surface will exert such functions as protection against oil-soiling, soil redeposition by washing and migration therethrough of disperse dye. On the other hand in the case of fibers of homogeneous blend, the streaky roughening of surface after being alkali treated is of comparatively low degree though component B remains on the surface, so that the finished fabric could not have a very good feeling. In particular, when dyed at a high temperature and under high pressure, a woven or knitted fabric made of the composite fiber of heterogeneous blend achieves a good bulk and touch as well as excellent drape and silhouette thanks to a full swelling effect produced by ethylene-vinyl alcohol copolymer, while fibers of a homogeneous blend can not produce such improvement effect.

The thermoplastic polyester as referred to in this invention is, for example, a fiber-forming polyester derived from an aromatic dicarboxylic acid such as terephthalic acid, isophthalic acid, naphthalene-2,6-dicarboxylic acid, phthalic acid, $\alpha,\beta$-(4-carboxyphenoxy)ethane, 4,4'-dicarboxydiphenyl or 5-sodium sulfoisophthalic acid; an aliphatic dicarboxylic acid such as adipic acid or sebacic acid; or esters of the foregoing; and a diol such as ethylene glycol, diethylene glycol, 1,4-butanediol, neopentyl glycol, cyclohexane-1,4-dimethanol, polyethylene glycol or polytetramethylene glycol. Preferred thermoplastic polyester is one having at least 80 mol %, more preferably at least 90 mol % of polyethylene terephthalate units or polybutylene terephthalate units. The polyester may contain small amounts of additives, a fluorescent agent, a stabilizer, an ultraviolet absorber, or the like.

As the saponified product of ethylene-vinyl acetate copolymer (hereinafter referred to as EVAL) used in the invention, those having an ethylene content of 30 to 70 mol % and a high saponification degree of at least 95% are most suited for the purpose of the invention. As the vinyl alcohol content in EVAL decreases, its characteristics such as hydrophilic property become less distinguished due to the decrease in the number of hydroxyl groups (OH), thereby, as later described in more detail, rendering the desired feeling like that of natural linen difficult to achieve, which is not preferred. On the other hand, if the vinyl alcohol content is too high, the melt formability of EVAL will decrease and also when such EVAL is blended with a polyester just before the spinning and then the blend is formed into filaments, the spinnability will become worse, resulting in frequent breakage of filaments and/or yarn, which is not preferred either. Furthermore, EVAL with such high vinyl alcohol content has an insufficient thermal resistance at a temperature range above 250° C., which is the spinning temperature for polyester. To summarize, it can be said that EVAL having a high saponification degree and a vinyl alcohol content of 30 to 70 mol % is most suited for obtaining the fiber achieving the object of the invention.

FIG. 5 is an example of photograph showing the cross section of the composite fibers of heterogeneous blend of the present invention after being processed by alkali etching. The composite fibers of heterogeneous blend had been obtained from an EVAL having an ethylene content of 48 mol % and a saponification degree of 99% and a polyethylene terephthalate in a blending ratio by weight of 15:85 by the later-described production process of the present invention. The composite fibers thus obtained had then been subjected to processes including drawing in the usual way, and then to about 20% alkali etching treatment. It is seen that the cross sectional shapes of individual fibers show randomly roughened surfaces each being different from others, which shapes have never been attained by the usual melt spinning of polyester. FIG. 5 is an example of cross sectional views of the composite fibers taken on optional points along the fiber length. It has been observed that other examples taken on different points each shows an aggregate of cross sections having different shapes, and that the same cross sectional shapes do not extend in the longitudinal direction of a fiber. This fact is one of the large features of the composite fiber of the present invention. Since irregularly distributed EVAL will swell by absorption of water upon immersion in high-temperature hot water or upon contact with high-temperature vapor, minute deformations generate at various parts, some part bending, some part twisting, randomly along fiber length and among the fibers containing the EVAL. This means that the composite fibers of the present invention are endowed with natural randomness, which have been impossible to achieve by conventional synthetic fibers. This is considered to be one of the reasons why the feeling of the composite fiber of the present invention is far different from those of conventional synthetic fibers and very much like those of natural fibers.

We consider the reason why the cross-sectional shapes as shown in FIG. 5 develop to be as follows. Since ethylene-vinyl alcohol copolymer and polyester is blended in a heterogeneous state, when the fiber of such blend is subjected to alkali etching treatment the polyester in the surface layer is dissolved and removed off selectively to permit aggregates of EVAL polymers, which can not be eroded by alkali, to remain as they are on the surface of the fiber, resulting in the formation of complex irregularly roughened surface. In addition, since the two polymer components are blended irregularly both across the fiber cross section and along the fiber length, the cross sectional shapes differ from each other both among individual fibers and along each fiber length, thereby permitting to develop a natural irregularity that has never been acquired by conventional synthetic fibers.

The composite fibers of the present invention can produce effect not only when used 100% as they are, but also when used while being mixed with other fibers. Furthermore, the fibers of the present invention can be used in the form of multifilament yarn as well as short cut staple, whereby the same degree of effect can be expected. The composite fibers having the good feeling, high functions and high effects of the present invention can also be obtained even when they are changed to be of cross sections similar to pentagon or hexagon by higher-order processing such as false-twist crimping processing, or when they have irregular cross-sectional shapes including multilobal cross sections such as trilobal, T-shape, tetralobal, pentalobal, hexalobal, heptalobal and octalobal, and the like irregular shapes, formed by the use of irregularly shaped nozzles at the spinning, as long as they have the fiber structure so far described.

Next, the process for producing the composite fiber of the present invention is described. It is important for the purpose of developing the fiber structure aimed at by the invention to, roughly speaking, extrude into filaments the blend of the two polymer components, i.e. polyester and EVAL, while maintaining a nonuniformly blended state of the two, where one polymer group is to some extent separated from the other. FIG. 6 is a cross-sectional view of a spinneret apparatus for conducting an example of such spinning process. Polyester and EVAL are separately extruded through melt extruders, then the extruded polymer melts are separately metered through metering pumps to prescribed flow rates, and the two flows are introduced from inlet holes 2 and 3 respectively of inlet plate 1, mixed under prescribed conditions with a static mixer provided in mixing plates 4 and 5. The blend then passes through intermediate plate 6, is filtered through filtration zone 12 in sand box 7, passes through filter 8 and straightening plate 9 and is finally extruded through spinneret 10.

It is very important to properly select the number of mixing elements of static mixer 11. When there is used, among several static mixers currently in use, a static mixer available from Kenics Co., the wings of which is each twisted 180° around the center axis and arranged at positions each shifting by 90° one after another, and which has the function of dividing a melt passing n elements into $2^n$ layers, the number of the element must be within the range of from 3 to 15, and preferably within the range of from 4 to 8. With the elements counting 16 or more, polyester and EVAL are blended too uniformly with each other for the obtained filaments to develop the desired fiber structure by after-processing treatment. If n is at least 16, the aforedescribed parameter, L, indicating heterogenuity of components A and B, will be less than D/20; while if n=4 to 8, L will be D/10 to D/2, thus giving preferred composite filaments of the composition heterogeneously blended.

Where a static mixer other than one available from Kenics Co. is used, it must be one with the number of elements being set corresponding to a division into $2^3$ to $2^{15}$ layers. High-Mixer available from Toray Co. and Ross ISG Mixer available from Charless & Ross Co. divide a melt passing n elements into $4^n$ layers, and in this case the number of elements is preferably selected from a range of from about 2 to about 8.

Influence of blending state of the polymers on the stability of spinning operation is described below. It has been found that if too many elements are used, polyester and EVAL will be blended too uniformly and chemical reaction will partly proceed between the ester bonds of polyester and the hydroxyl groups of EVAL polymer, resulting in a rapid formation of three-dimensionally crosslinked gels which are reaction products of the polyester and EVAL, together with low-molecular compounds degraded from the polyester, which then render spinning operation impossible to continue. It is therefore very effective also for preventing the formation of gels from the two polymers, to blend heterogeneously polyester and EVAL in a short time and just before spinning, which procedure can first realize stable fiber formation from a polymer blend of polyester and EVAL on a commercial scale.

In the present invention, it is much preferred that the composition comprising two polymer components heterogeneously blended with each other through a static mixer be passed, on its way to the nozzle, through dividing and/or fine-partitioning elements such as wire net, metallic nonwoven filter and sand filter, since such passage will prevent component A from growing to layers of large aggregates, give fine-island dispersion of component B in component A and stabilize the heterogeneously blended state of the two polymers, thereby stabilizing the spinning operation.

It is necessary that the blending ratio by weight of EVAL and polyester be within the range of from 5:95 to 40:60. If the blending ratio of EVAL be not more than 5% by weight, the feeling like that of natural fibers based on the features of EVAL polymer will not fully develop, which is not preferred. On the other hand if the blending ratio is at least 40% by weight, stabilities of spinning operation and drawing operation will decrease and, besides, the filaments obtained will be of poor fiber properties, e.g. low strength, far apart from those of polyester fibers. The polymerization degree of EVAL used is also important. If it is too low, there will be a large difference between melt viscosities of polyester and such EVAL at spinning, which worsen the stability of the heterogeneously blended polymer melts and decrease the spinnability, which is not preferred. A melt index measured according to JIS-K-6730-1977 at 190° C. under a load of 2160 g of not more than 20 g/10 min is suitable from the viewpoint of spinnability.

The thus obtained composite fiber of heterogeneous blend can be treated by alkali etching under known conditions being employed for the treatment of conventional polyester fibers. For example, immersion in an aqueous alkali solution of 40 g/l NaOH at 98° C. will lead to about 10 to 40% weight reduction.

Such alkali etching treatment can be conducted in any stage of the fiber processing, such as on yarn or on fabric but, commercially, the treatment is preferably conducted on fabrics in a stage after they have been prepared.

By the alkali etching treatment, composite filaments constituting the fabric form randomly roughened surfaces, each one being different from others, and hence the fabric composed of aggregates of such filaments will have a feeling extremely similar to that of natural fibers.

Other features of the invention will become apparent in the course of the following descriptions of exemplary embodiments which are given for illustration of the invention and are not intended to be limiting thereof.

EXAMPLES

In the following Examples and Comparative Examples, measurements were made according to the methods described below.

Intrinsic viscosity of polyester

Determined on a solution dissolved in a phenol/tetrachloroethylene (1/1) solvent in a constant temperature bath at 30° C. with Uberohde viscometer.

Soil redeposition by washing

Soiling solution was prepared by mixing with stirring by using a homomixer stearic acid, oleic acid, beef tallow, olive oil, cetyl alcohol, solid paraffin, cholesterol, carbon black, clay, silica, ferric oxide, n-decane and portland cement in an appropriate ratio. Test specimen was soiled using a launder-O-meter in the soiling solution thus prepared, washed with tap water stream, dried and then evaluated with a gray scale of JIS soiling test.

EXAMPLE 1

An ethylene-vinyl alcohol copolymer (A) having an ethylene content of 48 mol %, a saponification degree of 99% and a melt index of 14.0 g/10 min and a polyethylene terephthalate (B) having an intrinsic viscosity of 0.70 were melted and extruded separately through extruders, metered each with a gear pump such that the ratio of A to B would be 15 to 85 by weight, and the two melts were supplied to a spinning pack. Then, the melts were kneaded nonuniformly through a 4-element static mixer made by Kenics Co., and the kneaded melt was passed through a sand filter and extruded through round nozzles at a spinneret temperature of 290° C. to effect melt spinning at a take up speed of 1,000 m/min. The yarn thus spun was drawn by 3.2 times through a conventional roller-plate drawing machine at a hot roller temperature and a hot plate temperature of 75° C. and 120° C. respectively to give a multifilament yarn of 75d/36f. The spinnability and the drawability were good without any problem. The multifilament yarn obtained was used both as warps and wefts and woven into a 1/1 plain weave. There was no trouble in the weaving. The gray fabric thus obtained was treated in the usual way, then subjected to alkali etching treatment to give a plain weave having reduced about 20% the original weight, and the fabric was dyed in the usual way.

COMPARATIVE EXAMPLE 1

The same ethylene-vinyl alcohol copolymer (A) and polyethylene terephthalate as used in Example 1 both in chip-forms were mixed in a weight ratio of 15:85, and the mixture was melted and extruded through an extruder, metered with a gear pump and supplied to a spinning pack. There, the melt was passed through a sand filter and extruded through round nozzles at a spinneret temperature of 290° C. to effect melt spinning at a take up speed of 1,000 m/min. The yarn thus spun was then processed following the same procedure as in Example 1 to give a 1/1 plain weave, which was then alkali-treated. As a control, a plain weave having the same structure and weight composed of a PET 100% multifilament yarn of 75d/36f was prepared and alkali-treated.

Figure 1:
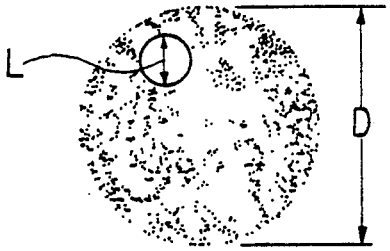
FIGS. 1, 2 and 3 show diagrammatical copies of the photographs of the cross sections of the composite fibers of the present invention.
Figure 4:
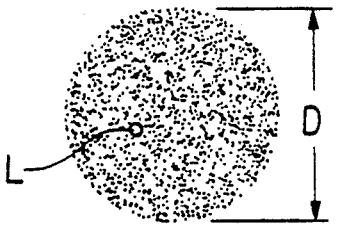
FIG. 4 is a diagrammatical copy of the photograph of the cross section of a fiber of homogeneous blend in Comparative Examples.

Results of evalutions on the fabrics of Example 1 and Comparative Example are shown in Table 1. The fiber cross section of the yarn as spun in Example 1 and that in Comparative Example 1 are shown in FIG. 1 and FIG. 4 respectively. As shown in Table 1, while EVAL geled to cause spinneret pack clogging and the spinnability became worse in about 3 hours in Comparative Example 1, such unfavorable phenomena were not observed in Example 1. Furthermore, in Example 1, the localization parameter, L, of components A and B was D/2 to D/20, and fabric wave was good to shrink well to give the finished fabric having both high bulk and flexibility as well as high-class feeling with soft touch and high resilience, while samples of Comparative Example 1 were paper-like. With respect to the functionality, the fabric of Example 1 was far superior to those of Comparative Example and control in the resoiling evaluation by using soiling solution at washing.

The cross sections of the fibers constituting the fabric of Example 1 were microscopically observed to be as shown in FIG. 5, where single filaments had randomly roughened surface structures, any one of which being different from others.

EXAMPLES 2 THROUGH 5 AND COMPARATIVE EXAMPLES 2 AND 3

The Examples herein show the cases where alkali etching treatment was not conducted on fibers. Example 1 was repeated with the same ethylene-vinyl alcohol copolymer and polyethylene terephthalate under the conditions shown in Table 2 to perform formation of fibers. The fibers obtained were each woven into a plain weave, which was then dyed and finished in the same manner as in Example 1. In Comparative Example 2, where the blending ratio of EVAL is too low, the obtained fabric showed no particular features in the feeling or in the functionality and hence it was not satisfactory, although its processability was good. In Comparative Example 3, where the blending ratio of EVAL is too high, the spinnability was unstable and frequent filament breakages occurred due to nozzle clogging to give only unfavorable yarn as spun. The drawability therefore was not satisfactory either and any fabric which could be evaluated for feeling was not obtained. In Examples 2 and 3, where the blending ratio of EVAL (A) and polyester (B), A/B, are 7/93 and 30/70 respectively, the processability was good, and the obtained fabrics showed high-class feeling and also high protection performance against soil redeposition by washing. In Examples 4 and 5, where the number of elements of the static mixer in the spinning pack were 8 and 12 respectively, the processability was good. In these cases the localization parameter, D/L, of components A and B in the fibers as spun were 5 to 25, or 7 to 15 in averages, showing effective localizations, which gave particular features to the fibers both in the feeling and functionality.

TABLE 1

| | Spinnability | Fiber diameter D | Area occupied by component B L | D/L | Wave in the cloth after being dyed | Hand and bulk | Flexibility | Protection against resoiling by washing |
|---|---|---|---|---|---|---|---|---|
| Ex. 1 | good | 14.5 μm | 0.7~7.0 μm | 2~20 | 11% | good | good | class 4 |
| Comp. Ex. 1 | not good; spinneret pack clogged 3 hours after start | 14.5 μ | 0.3~0.6 μ | 24~48 | 6% | not good | not good | class 2 |
| Control PET 100% | — | 14 μ | — | — | 5% | not good | not good | class 1 |

TABLE 2

| | A Ethylene-vinyl alcohol copolymer | | | | | Spinning condition | | | | Hand | | Protection against resoiling by washing |
|---|---|---|---|---|---|---|---|---|---|---|---|---|
| | Ethylene content (mol %) | Sapoification degree of vinyl acetate component (%) | MI (g/10 min) | B Polyester Type | B Polyester [μ] | Blending ratio | Number of elements of mixer | Spinnability | D/L | Bulk | Flexibility | |
| Comparative Example 2 | 48 | 99 | 14.0 | PET | 0.70 | 3/97 | 4 | good | 1.3~10 | not good | marginal | class 2 |
| Example 2 | 48 | 99 | 14.0 | PET | 0.70 | 7/93 | 4 | good | 2~15 | between marginal and good | good | class 2~3 |
| Example 3 | 48 | 99 | 14.0 | PET | 0.70 | 30/70 | 4 | good | 5~10 | good | good | class 5 |
| Example 4 | 48 | 99 | 14.0 | PET | 0.70 | 15/85 | 8 | good | 5~20 | good | good | class 4~5 |
| Example 5 | 48 | 99 | 14.0 | PET | 0.70 | 15/85 | 12 | good | 7~25 | good | good | class 4 |
| Comparative Example 3 | 48 | 99 | 14.0 | PET | 0.70 | 50/50 | 4 | not good | 10~30 | No woven fabric evaluatable could be obtained. | | |

EXAMPLES 6 AND 7 the knitted fabrics finished showed good feeling and touch similar to those of linen-blended spun knit.

TABLE 3

| | Ethylene-vinyl alcohol copolymer (A) | | | Spinning condition | | | | Hand of knitted fabric | |
|---|---|---|---|---|---|---|---|---|---|
| | Ethylene content (mol %) | Saponification degree of vinyl acetate component % | Melt index (g/10 min) | Blending ratio A/B | Number of elements of static mixer | Spinnability | Localization parameter D/L | Bulk | Touch |
| Comparative Example 4 | 25 | 99 | 0.6 | 15/85 | 4 | poor, spinneret pack pressure increased | — | No knitted fabric evaluatable could be obtained. | |
| Example 8 | 32 | 99 | 1.6 | 15/85 | 4 | good | 2~20 | good | good |
| Example 9 | 44 | 99 | 6.0 | 15/85 | 4 | good | 2~20 | good | good |
| Comparative Example 5 | 80 | 99 | 40 | 15/85 | 4 | good | 2~20 | marginal | good |

Example 1 was repeated except for using an ethylene-vinyl alcohol copolymer having an ethylene content of 52 mol %, a saponification degree of 99% and a melt index (MI value) of 6.0 g/10 min, and changing the spinneret nozzle and the blending ratio, A/B, to conduct fiber formation. A T-type nozzle was used with the blending ratio, A/B, of 10/90 in Example 6, and a dog-bone shaped nozzle was used with the blending ratio, A/B, of 18/82 in Example 7.

Figure 2:
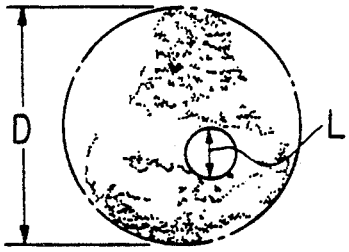
Figure 3:
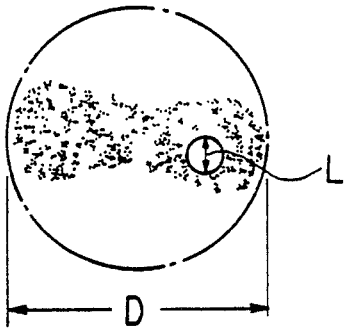

FIGS. 2 and 3 show respective cross sections of as-spun fibers in the Examples. The spinnability, drawability, weavability and the like were all good. When the yarn after being drawn were immersed in hot water, each single filament, which had been straight, generated slight deformations to thereby form distortions with random bending, at various parts thereof. When the fabrics were subjected to alkali treatment to 25% weight reduction, both gave agreeable feeling with bulk resembling that of wild silk yarn fabric.

EXAMPLES 8 AND 9 AND COMPARATIVE EXAMPLES 4 AND 5

Example 1 was repeated except for using ethylene-vinyl alcohol copolymers having different ethylene contents and a polyester component B with an [η] of 0.68 to conduct fiber formation, followed by knitting into fabrics and dyeing of the obtained fabrics. Here, the fabrics were first swollen by treatment with high-temperature and high-pressure water at 130° C. for 30 minutes, and then treated with alkali to a weight reduction of 15%. The thus treated fabrics were dyed, finished and evaluated for feeling. Type of EVAL's used are:

| | Ethylene content | MI value |
|---|---|---|
| Comparative Example 4 | 25 mol % | 0.6 g/10 cm |
| Example 8 | 32 | 1.6 |
| Example 9 | 44 | 6.0 |
| Comparative Example 5 | 80 | 40.0 |

The results are shown in Table 3. In Comparative Example 4, spinnability was bad and, since gels of polymer A clogged on the spinning filter to cause a pressure rise and intermingled into fibers, the drawability was also bad and no knitted fabric which could be evaluated was obtained. On the other hand, in Comparative Example 5, where the molar fraction of vinyl alcohol component was small, although the processability was good the knitted fabric obtained had little bulk and unsatisfactory touch due to changes of loops of the knit at drying. In Examples 8 and 9, the processability was good and

COMPARATIVE EXAMPLE 6 AND 7

Example 1 was repeated except for changing the number of static mixer elements to conduct fiber formation; 16 elements and 20 elements in Comparative Example 6 and Comparative 7 respectively. In both cases the spinneret pack had to be exchanged frequently for the continuous spinning operation to proceed due to, estimatedly, the fact that kneading of polymer A (EVAL) and polymer B (polyester) was conducted too uniformly so that reaction of the hydroxyl groups of EVAL with the ester bonds of polyester occurred in a melted and mixed state of the two polymers, resulting in generation of many gels in the mixed polymers. In particular, in Comparative Example 7 where 20 elements were used, filament breakage at spinning and fluff generation at drawing occurred quite often to decrease the yield and the processability was thus bad. Furthermore, most of the localization parameters, D/L's, of polymers A and B in the fibers as spun were at least 20 with only a small part less than 20, and hence the knitted fabrics prepared and processed in the same manner as in Example 8 had paper-like feeling without any bulky touch.

EXAMPLES 10 AND 11

Example 1 was repeated except for using as a polyester a butylene terephthalate having an intrinsic viscosity, [η], 0.90 and as an ethylene-vinyl alcohol copolymer one having an ethylene content of 52 mol %, a saponification degree of 99% and a melt index of 14.0 (Example 10) or 6.0 g/10 min (Example 11) to conduct fiber formation. The polymer blending ratio, A/B, was 15/85 for Example 10 and 30/70 for Example 11. The spinneret temperature was 270° C. and the take-up speend was 1200 m/min. The as-spun yarns obtained were drawn to a drawing ratio of 2.0 with a conventional roller-plate drawing machine at a hot roller temperature and hot plate temperature of 50° C. and 120° C. respectively to give multifilament yarns of 75d/36f. The spinnability and the drawability were good and no trouble was encountered.

The multifilament yarns thus obtained were each used both as warps and wefts and woven into a 1/1 plain fabric. No trouble was encountered in the weaving. The gray fabrics obtained were treated in the usual way, then subjected to alkali etching treatment for a longer time than that in the case of 100% polyester fabric to a weight reduction of 20% and thereafter dyed at 120° C. in the same manner as in Example 1. The fabrics thus obtained were quite like natural linen fabric, having good feeling with soft and linen-like touch.

Obviously, numerous modifications and variations of the present invention are possible in light of the above teachings. It is therefore to be understood that within the scope of the appended claims, the invention may be practiced otherwise than as specifically described herein.

What is claimed is:

1. A composite fiber of ethylene-vinyl alcohol copolymer and polyester heterogeneously blended with each other, comprising a saponified product of an ethylene-vinyl acetate copolymer (A) having an ethylene content of 30 to 70 mol % and a saponification degree of at least 95% and a thermoplastic polyester (B) containing polyethylene terephthalate, polybutylene terephthalate or a copolymer of polyethylene terephthalate containing at least 80 mol % of polyethylene terephthalate units or a copolymer of polybutylene terephthalate containing at least 80 mol % of polybutylene terephthalate units in a blending ratio by weight of A: B=5:95 to 40:60, said component A being distributed in the form of islands in the cross section of the fiber, the region in the cross section of the fiber of said component (B) where component (A) is not present containing a component (B) zone having a circular area with a diameter at least 1/20 that of the fiber.

2. The composite fiber of claim 1, wherein the amount of polyethylene terephthalate units or polybutylene terephthalate units in said copolymer of component (B) is at least 90 mol %.

* * * * *